US009121278B2

(12) United States Patent
Takayama et al.

(10) Patent No.: US 9,121,278 B2
(45) Date of Patent: Sep. 1, 2015

(54) POSITIVE DISPLACEMENT EXPANDER AND REFRIGERATION CYCLE APPARATUS INCLUDING POSITIVE DISPLACEMENT EXPANDER

(75) Inventors: Keisuke Takayama, Tokyo (JP); Yusuke Shimazu, Tokyo (JP); Masayuki Kakuda, Tokyo (JP); Hideaki Nagata, Tokyo (JP); Takeshi Hatomura, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 297 days.

(21) Appl. No.: 13/518,042

(22) PCT Filed: Jan. 19, 2010

(86) PCT No.: PCT/JP2010/000257

§ 371 (c)(1),
(2), (4) Date: Aug. 24, 2012

(87) PCT Pub. No.: WO2011/089638

PCT Pub. Date: Jul. 28, 2011

(65) Prior Publication Data

US 2012/0321497 A1 Dec. 20, 2012

(51) Int. Cl.
*F01C 11/00* (2006.01)
*F03C 2/02* (2006.01)
(Continued)

(52) U.S. Cl.
CPC ..... *F01C 20/26* (2013.01); *F01C 1/0223* (2013.01); *F01C 13/04* (2013.01); *F01C 20/06* (2013.01)

(58) Field of Classification Search
CPC ..... F01C 20/06; F01C 20/24; F01C 20/26; F01C 13/00; F01C 13/04
USPC ..... 418/55.1, 3, 15, 60, 58, 14, 17
See application file for complete search history.

(56) References Cited

U.S. PATENT DOCUMENTS 5,938,417 A * 8/1999 Takao et al. ..... 418/55.2
7,419,369 B2 * 9/2008 Sakitani et al. ..... 418/3
2006/0165542 A1 7/2006 Sakitani et al.

FOREIGN PATENT DOCUMENTS

JP 07-189945 A 7/1995
JP 07-301186 A 11/1995
(Continued)

OTHER PUBLICATIONS

Electromagnetic Field Analysis and Dynamic Simulation of a Two-Vave Solenoid Actuator, Wang et al, IEEE Transactions of Magnetics, vol. 29, No. 2, Mar. 1993.*
(Continued)

*Primary Examiner* — Kenneth Bomberg
*Assistant Examiner* — Deming Wan
(74) *Attorney, Agent, or Firm* — Buchanan Ingersoll & Rooney PC

(57) ABSTRACT

Disclosed is a positive displacement expander equipped with an expansion mechanism in which power is generated using fluid energy produced while a high-pressure fluid, supplied to a plurality of expansion chambers partitioned by an orbiting scroll or a rolling piston, is being expanded and decompressed. The expander includes a communicating pipe that allows each of the expansion chambers to communicate with an expander discharge side and an opening and closing device disposed on the communicating pipe. When supply of the high-pressure fluid is stopped, the opening and closing device is opened by the time when high and low pressures between each of the expansion chambers and the expander discharge side are equalized, thus stopping the orbiting scroll or the rolling piston at a predetermined position so that an expander obtains sufficient driving force when resuming.

8 Claims, 5 Drawing Sheets

(51) Int. Cl.

| | |
|---|---|
| ***F01C 1/02*** | (2006.01) |
| ***F03C 4/00*** | (2006.01) |
| ***F04C 2/00*** | (2006.01) |
| ***F04C 18/00*** | (2006.01) |
| ***F03C 2/00*** | (2006.01) |
| ***F01C 20/26*** | (2006.01) |
| ***F01C 13/04*** | (2006.01) |
| ***F01C 20/06*** | (2006.01) |

(56) References Cited

FOREIGN PATENT DOCUMENTS

| | | | |
|---|---|---|---|
| JP | 2004-190559 | A | 7/2004 |
| JP | 2007-332819 | A | 12/2007 |
| JP | 2008/180148 | A | 8/2008 |
| JP | 2009-109158 | A | 5/2009 |

OTHER PUBLICATIONS

Office Action (Notice of Reasons for Rejection) dated Jul. 9, 2013, issued by the Japanese Patent Office in the corresponding Japanese Patent Application No. 2011-550707 and an English translation thereof. (5 pages).

Office Action issued on Dec. 2, 2013, by the Chinese Patent Office in corresponding Chinese Patent Application No. 201080061816.5, and an English Translation of the Office Action. (6 pages).

International Search Report (PCT/ISA/210) issued on Mar. 30, 2010, by the Japanese Patent Office as the International Searching Authority for International Application No. PCT/JP2010/000257.

* cited by examiner

POSITIVE DISPLACEMENT EXPANDER AND REFRIGERATION CYCLE APPARATUS INCLUDING POSITIVE DISPLACEMENT EXPANDER

TECHNICAL FIELD

The present invention relates to a positive displacement expander capable of recovering, as power, fluid energy during an expansion process and a refrigeration cycle apparatus including the positive displacement expander.

BACKGROUND ART

There is known a traditional refrigeration cycle apparatus that includes a compressor having an orbiting scroll which is driven by a motor and is configured to compress a refrigerant, a radiator which dissipates heat of the refrigerant compressed by the compressor, an expander having a rolling piston which is configured to decompress the refrigerant that has passed through the radiator, and an evaporator which allows the refrigerant decompressed by the expander to evaporate. Such a refrigeration cycle apparatus has been known which has a communicating path connecting an intermediate position of the expansion process in an expansion chamber (a section partitioned by the rolling piston in the expansion chamber) to an outlet position (outlet port side) such that when a pressure in the expansion chamber excessively drops, fluid on the outlet side is returned to the expansion chamber in order to prevent overexpansion and thus prevents a drop in power recovery efficiency (refer to, for example, Patent Literature 1).

In addition, a refrigerating and air-conditioning apparatus is known that includes a scroll expander, which expands and decompresses a refrigerant cooled by a radiator to recover power, and a scroll auxiliary compressor, which is driven by power recovered by the expander and compresses the refrigerant in an auxiliary manner. With the auxiliary compression of the refrigerant by the auxiliary compressor, load on a main compressor is reduced, the electric power necessary for a drive motor of the main compressor is reduced, and, thus, efficiency of the refrigeration cycle apparatus is increased (refer to, for example, Patent Literature 2).

CITATION LIST

Patent Literature

Patent Literature 1: Japanese Unexamined Patent Application Publication No. 2004-190559 (FIGS. 4 and 15)

Patent Literature 2: Japanese Unexamined Patent Application Publication No. 2009-109158 (FIG. 1)

SUMMARY OF INVENTION

Technical Problem

As disclosed in Patent Literature 2, when a drive shaft of the expander is not connected to the motor or a generator and the expander is activated only using the fluid energy of the refrigerant, depending on a stop position of the orbiting scroll constituting the expander, there has been a possibility of startup failure of the expander due to lack of driving force when reactivating the refrigeration cycle apparatus.

Stopping of the orbiting scroll (or the rolling piston) of the expander at a predetermined position can be controlled by determining the position in which the refrigerant in the expansion chamber is released to a low-pressure side. For this, a communicating path bypassing the refrigerant from an intermediate portion of the expansion chamber to the low-pressure side is needed.

As regards the communicating path bypassing the refrigerant from an intermediate portion of the expansion chamber to the low-pressure side, the communicating path of Patent Literature 1 connecting the intermediate position of the expansion process in the expansion chamber (a section partitioned by the rolling piston in the expansion chamber) to an outlet position (outlet port side) can be used so that, for example, the refrigerant in the expansion chamber can be discharged to the outlet side. However, in a power recovery expander driven by fluid energy generated during decompression of the refrigerant, as described above, when the refrigerant in the expansion chamber is discharged by way of connecting the communicating path communicating with the low-pressure side to one of the sections partitioned by the orbiting scroll (or the rolling piston) in the expansion chamber, there has existed a risk of the rolling piston or the orbiting scroll stopping in the intermediate position of the expansion process in the expansion chamber and sufficient driving force cannot be obtained in the expander when reactivating the refrigeration cycle apparatus again.

A technical challenge of the present invention is to achieve control of the stop position of the orbiting scroll or the rolling piston of the expander and to obtain sufficient driving force in the expander when resuming.

Solution to Problem

The present invention provides a positive displacement expander equipped with an expansion mechanism in which power is generated using fluid energy generated while a high-pressure fluid, supplied to a plurality of expansion chambers partitioned by an orbiting scroll or an rolling piston, is being expanded and decompressed, the positive displacement expander including a communicating path that allows each of the expansion chambers to communicate with an expander discharge side; and an opening and closing device disposed in the communicating path, in which when supply of the high-pressure fluid is stopped, the opening and closing device is opened by the time when high and low pressures between each expansion chamber and the expander discharge side are equalized, thus stopping the orbiting scroll or the rolling piston at a predetermined position.

Advantageous Effects of Invention

In the positive displacement expander according to the present invention, when the supply of the high-pressure fluid is stopped, a stop position of the orbiting scroll or the rolling piston can be controlled so that the expander can be easily resumed. Advantageously, this prevents such startup failure that the orbiting scroll or the rolling piston does not orbit when resuming.

DESCRIPTION OF EMBODIMENTS

Embodiment 1

Figure 1:
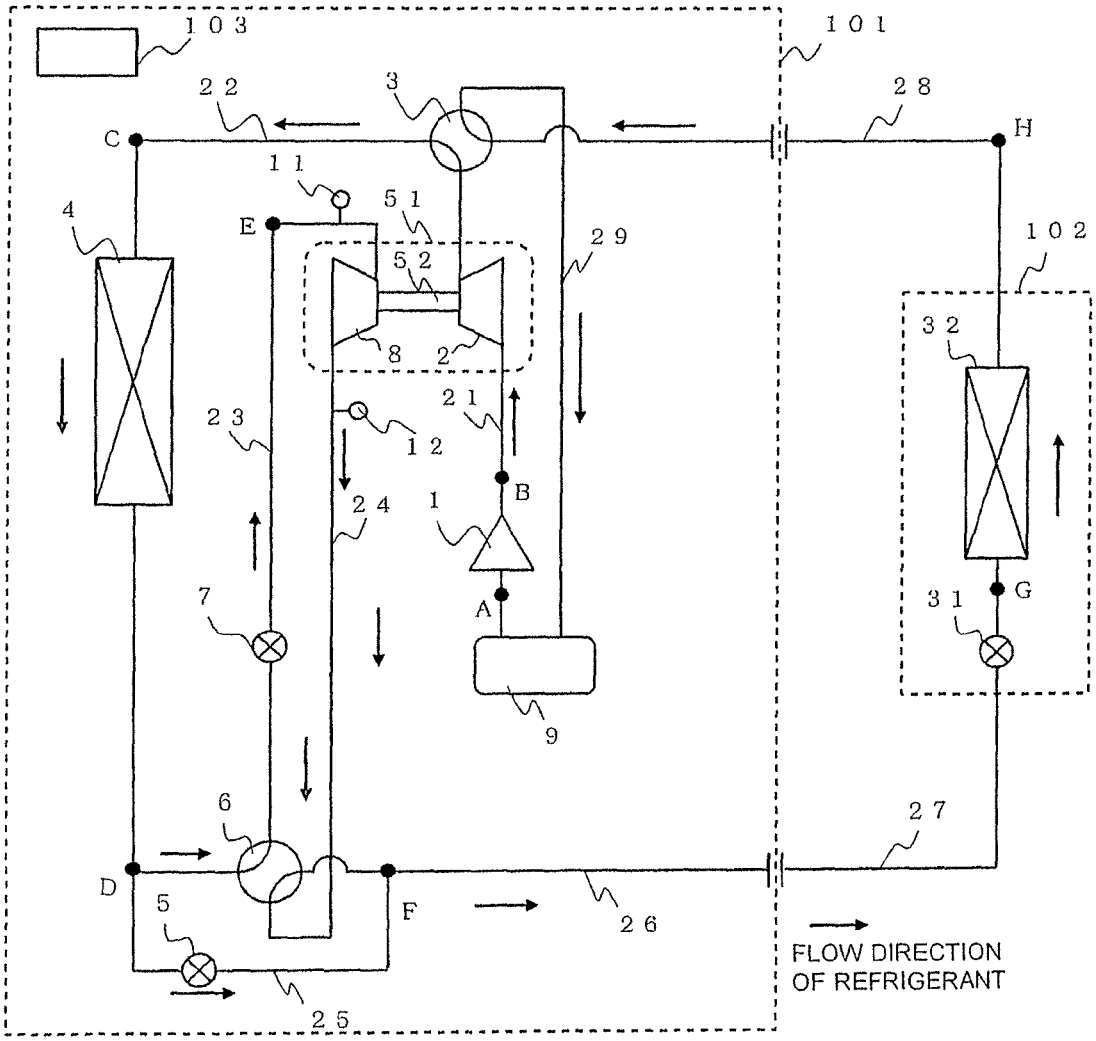
FIG. 1 is a diagram illustrating a refrigerant circuit of a refrigeration cycle apparatus using a positive displacement expander according to Embodiment 1 of the present invention.

FIG. 1 is a diagram illustrating a refrigerant circuit in a cooling operation of a refrigeration cycle apparatus, such as an air-conditioning apparatus, including a positive displacement expander according to Embodiment 1 of the present invention.

Referring to FIG. 1, the air-conditioning apparatus according to Embodiment 1 includes a main compressor 1 that is driven by an electric motor (not illustrated) and is configured to compress a sucked refrigerant and discharge the compressed refrigerant, and an outdoor heat exchanger 4 configured to function as a radiator, in which the refrigerant dissipates heat, in the cooling operation, and function as an evaporator, in which the refrigerant evaporates, in a heating operation. The air-conditioning apparatus further includes an expander 8 configured to decompress the refrigerant passing therethrough and an indoor heat exchanger 32 configured to function as an evaporator, in which the refrigerant evaporates, in the cooling operation and function as a radiator, in which the refrigerant dissipates heat, in the heating operation. The air-conditioning apparatus further includes a drive shaft 52 configured to recover power generated during decompression of the refrigerant by the expander 8, and a scroll type auxiliary compressor 2 that is driven by power recovered by the drive shaft 52 and that is configured to compress the refrigerant in an auxiliary manner.

This air-conditioning apparatus uses carbon dioxide as the refrigerant. Carbon dioxide has an ozone depletion potential of zero and a lower global warming potential as compared with traditional fluorocarbon refrigerants.

In Embodiment 1, the main compressor 1, the auxiliary compressor 2, a first four-way valve 3 and a second four-way valve 6 which are refrigerant flow switching devices, the outdoor heat exchanger 4, a bypass valve 5, a pre-expansion valve 7, the expander 8, and an accumulator 9 are housed in an outdoor unit 101. An expansion valve 31 and the indoor heat exchanger 32 are housed in an indoor unit 102. A controller 103 configured to control the whole of the air-conditioning apparatus is housed in the outdoor unit 101. Note that although the number of indoor units 102 (indoor heat exchangers 32) is one in Embodiment 1, any number of indoor units 102 (indoor heat exchangers 32) may be used. The outdoor unit 101 is connected to the indoor unit 102 through a liquid pipe 27 and a gas pipe 28.

More specifically, the auxiliary compressor 2 and the expander 8 are housed in a container 51. The auxiliary compressor 2 is connected to the expander 8 through the drive shaft 52, such that power generated in the expander 8 is recovered by the drive shaft 52 and is transferred to the auxiliary compressor 2. Accordingly, the auxiliary compressor 2 sucks the refrigerant discharged from the main compressor 1 and further compresses the refrigerant.

A refrigerant passage between the auxiliary compressor 2 and the outdoor heat exchanger 4 and a refrigerant passage between the indoor heat exchanger 32 and the accumulator 9 are connected to the first four-way valve 3, serving as the refrigerant flow switching device. In addition, a refrigerant passage between the outdoor heat exchanger 4 and the expander 8 and a refrigerant passage between the expander 8 and the expansion valve 31 are connected to the second four-way valve 6. The four-way valves 3 and 6 each switch between passages associated with an operation mode related to cooling or heating in accordance with an instruction from the controller 103 to switch between refrigerant paths.

In the cooling operation, the refrigerant flows from the auxiliary compressor 2 to the outdoor heat exchanger 4 and flows from the indoor heat exchanger 32 to the accumulator 9. Furthermore, the refrigerant flows from the outdoor heat exchanger 4 through the expander 8 to the indoor heat exchanger 32.

In the heating operation, the refrigerant flows from the auxiliary compressor 2 to the indoor heat exchanger 32 and flows from the outdoor heat exchanger 4 to the accumulator 9. In addition, the refrigerant flows from the indoor heat exchanger 32 through the expander 8 to the outdoor heat exchanger 4.

The first and second four-way valves 3 and 6 permit the refrigerant passing through the expander 3 and that passing through the auxiliary compressor 2 to flow in the same direction regardless of the cooling operation or the heating operation.

The outdoor heat exchanger 4 includes fins (not illustrated) for increasing the area of heat transfer between, for example, a heat transfer tube through which the refrigerant is allowed to pass and the refrigerant flowing therethrough and outside air to exchange heat between the refrigerant and the air (outside air). For example, the outdoor heat exchanger 4 functions as an evaporator in the heating operation to evaporate the refrigerant into a gas (vapor). Whereas, the outdoor heat exchanger 4 functions as a condenser or gas cooler (hereinafter, referred to as a condenser) in the cooling operation. In some cases, the outdoor heat exchanger 4 does not completely convert the refrigerant into a gas or liquid and produces a two-phase mixture of gas and liquid (two-phase gas-liquid refrigerant).

The accumulator 9 has a function of retaining an excess refrigerant in the refrigeration cycle and a function of preventing the main compressor 1 from being damaged by returning a large amount of refrigerant to the main compressor 1.

The pre-expansion valve 7 configured to control the flow rate of the refrigerant passing through the expander 8 is disposed in a refrigerant passage 23 between the second four-way valve 6 and an inlet of the expander 8.

The second four-way valve 6, the pre-expansion valve 7, a bypass 25 that bypasses the expander 8, and the bypass valve 5 configured to control the flow rate of the refrigerant passing through the bypass 25 are arranged in a refrigerant passage between the outdoor heat exchanger 4 and the indoor heat exchanger 32.

Controlling the bypass valve 5 and the pre-expansion valve 7 controls the flow rate of the refrigerant passing through the expander 8 and controls a pressure on a high-pressure side. Thus, the refrigeration cycle can be kept in a high efficiency state.

Note that control is not limited to control of the bypass valve 5 and the pre-expansion valve 7 and the pressure on the high-pressure side may be controlled by other methods.

A pressure sensor 11 configured to detect the pressure of the refrigerant flowing into the expander 8 is disposed at the inlet of the expander 8. In addition, a pressure sensor 12 configured to detect the pressure of the refrigerant flowing out of the expander 8 is disposed at an outlet of the expander 8. Installation positions of the pressure sensors 11 and 12 are not limited to the above-described positions. As long as the sensors can detect the pressure of the refrigerant flowing into the expander 8 and that of the refrigerant flowing out of the expander 8, the sensors may be arranged in any positions.

If those pressures can be estimated, temperature sensors configured to detect the temperature of the refrigerant may be used instead of the pressure sensors 11 and 12.

The indoor heat exchanger 32 includes fins (not illustrated) for increasing the area of heat transfer between, for example, a heat transfer tube through which the refrigerant is allowed to pass and the refrigerant flowing therethrough and the air to exchange heat between the refrigerant and the indoor air. For example, the indoor heat exchanger 32 functions as an evaporator in the cooling operation to evaporate the refrigerant into a gas (vapor). Whereas, the indoor heat exchanger 32 functions as a condenser or gas cooler (hereinafter, referred to as a condenser) in the heating operation.

The indoor heat exchanger 32 is connected to the expansion valve 31. The expansion valve 31 controls the flow rate of the refrigerant flowing into the indoor heat exchanger 32. In the case where the refrigerant is not sufficiently decompressed by the expander 8, a pressure level is controlled by the expansion valve 31.

<Operations of Air-Conditioning Device>

An operation in the cooling operation of the refrigeration cycle apparatus according to Embodiment 1, that is, the air-conditioning apparatus will now be described with reference to FIG. 1 illustrating the diagram of the refrigerant circuit. Here, the highs and lows of the pressure in the refrigeration cycle or the like are not determined in relation to a reference pressure. The highs and lows of the pressure is expressed as a relative pressure obtained between the compression of the main compressor 1 and the auxiliary compressor 2, decompression of the bypass valve 5 and the expander 8, or the like. The same applies to the highs and lows of the temperature.

In the cooling operation, a low-pressure refrigerant, first sucked in by the main compressor 1, is compressed into a high-temperature medium-pressure refrigerant and is then discharged from the main compressor 1. The refrigerant discharged from the main compressor 1 is sucked into the auxiliary compressor 2, is further compressed into a high-temperature high-pressure refrigerant, and is then discharged from the auxiliary compressor 2. The refrigerant discharged from the auxiliary compressor 2 passes through the first four-way valve 3, flows into the outdoor heat exchanger 4, dissipates heat to transfer heat to the outdoor air, and turns into a low-temperature high-pressure refrigerant.

The refrigerant, which has flowed out of the outdoor heat exchanger 4, branches into a channel toward the second four-way valve 6 and a channel toward the bypass valve 5. The refrigerant, which has passed through the second four-way valve 6, passes through the pre-expansion valve 7, enters the expander 8, and is decompressed into a low-pressure refrigerant, so that the refrigerant enters a low state of dryness. At this time, power is generated in the expander 8 with a decrease in pressure of the refrigerant. This power is recovered by the drive shaft 52, is transferred to the auxiliary compressor 2, and is used to compress the refrigerant in the auxiliary compressor 2.

The refrigerant discharged from the expander 8 passes through the second four-way valve 6 and then merges with the refrigerant, which has passed through the bypass valve 5 and flowed through the bypass 25. The resultant refrigerant flows out of the outdoor unit 101, passes through the liquid pipe 27, enters the indoor unit 102, flows toward the expansion valve 31, and is further decompressed by the expansion valve 31.

The refrigerant, which has flowed out of the expansion valve 31, removes heat from the indoor air to evaporate in the indoor heat exchanger 32, so that the refrigerant obtains a high state of dryness while being kept at a low pressure. Consequently, the indoor air is cooled.

The refrigerant, which has flowed out of the indoor heat exchanger 32, flows out of the indoor unit 102, passes through the gas pipe 28, enters the outdoor unit 101, passes through the first four-way valve 3, enters the accumulator 9, and is again sucked into the main compressor 1.

Repeating the above-described operation transfers heat of the indoor air to the outdoor air, so that an indoor space is cooled.

An operation in the heating operation of the refrigeration cycle apparatus according to Embodiment 1, that is, the air-conditioning apparatus will now be described.

In the heating operation, a low-pressure refrigerant, first sucked by the main compressor 1, is compressed into a high-temperature medium-pressure refrigerant and is then discharged from the main compressor 1. The refrigerant discharged from the main compressor 1 is sucked into the auxiliary compressor 2, is further compressed into a high-temperature high-pressure refrigerant, and is then discharged from the auxiliary compressor 2. The refrigerant discharged from the auxiliary compressor 2 passes through the first four-way valve 3 and flows out of the outdoor unit 101.

The refrigerant, which has flowed out of the outdoor unit 101, passes through the gas pipe 28, enters the indoor unit 102, flows towards the indoor heat exchanger 32, dissipates heat to transfer heat to the indoor air in the indoor heat exchanger 32, and turns into a low-temperature high-pressure refrigerant.

The refrigerant, which has flowed out of the indoor heat exchanger 32, is decompressed by the expansion valve 31, and flows out of the expansion valve 31. The refrigerant, which has flowed out of the expansion valve 31, flows out of the indoor unit 102, passes through the liquid pipe 27, enters the outdoor unit 101, and branches into a channel toward the second four-way valve 6 and a channel toward the bypass valve 5. The refrigerant, which has passed through the second four-way valve 6, passes through the pre-expansion valve 7, enters the expander 8, and is decompressed into a low-pressure refrigerant, so that the refrigerant enters a low state of dryness. At this time, power is generated in the expander 8 with a decrease in pressure of the refrigerant. This power is recovered by the drive shaft 52, is transferred to the auxiliary compressor 2, and is used to compress the refrigerant in the auxiliary compressor 2.

The refrigerant discharged from the expander 8 passes through the second four-way valve 6 and then merges with the refrigerant, which has passed through the bypass valve 5 and flowed through the bypass 25. The resultant refrigerant enters the outdoor heat exchanger 4.

The refrigerant removes heat from the outdoor air to evaporate in the outdoor heat exchanger 4, so that the refrigerant obtains a high state of dryness while being kept at a low pressure.

The refrigerant, which has flowed out of the outdoor heat exchanger 4, passes through the first four-way valve 3, enters the accumulator 9, and is again sucked into the main compressor 1.

Repeating the above-described operation transfers heat of the outdoor air to the indoor air, so that the indoor space is heated.

The structure and operation of a scroll expander 8 and that of a scroll auxiliary compressor 2 will now be described as examples of the expander 8 and the auxiliary compressor 2. Note that the auxiliary compressor 2 and the expander 8 are not limited to a scroll type. An auxiliary compressor and an expander of other positive displacement types, for example, a rolling piston type may be used.

Figure 2:
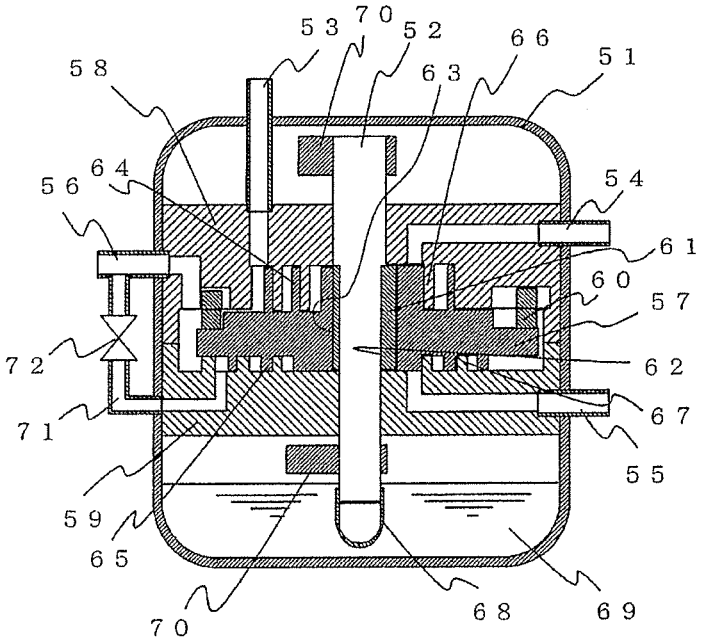
FIG. 2 is a longitudinal sectional view of the positive displacement expander according to Embodiment 1 of the present invention.
Figure 3:
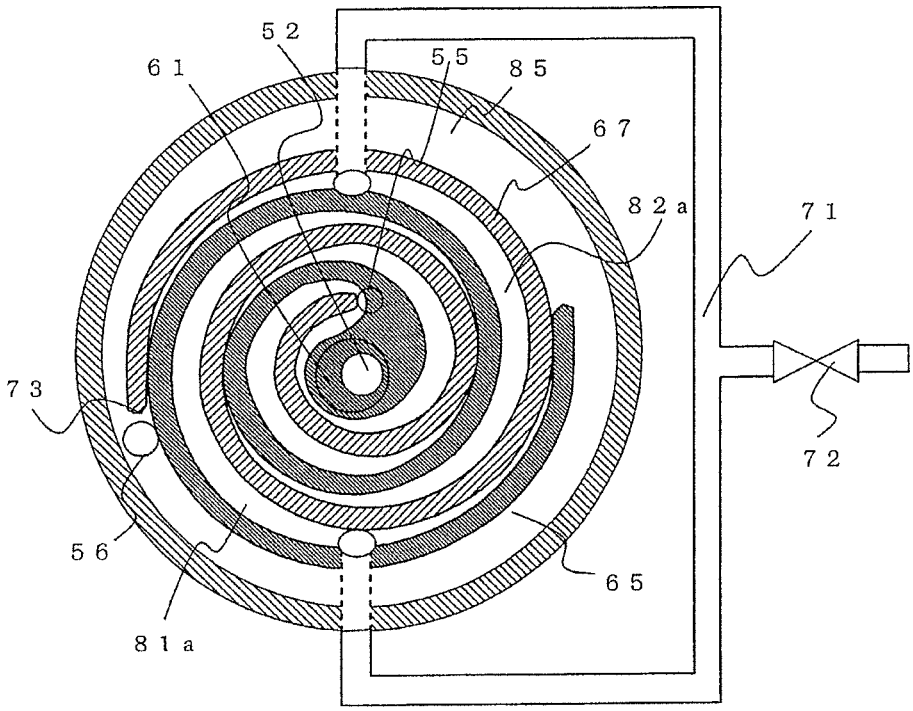
FIG. 3 is a schematic cross-sectional view of spiral wraps of the positive displacement expander according to Embodiment 1 of the present invention.

FIG. 2 is a cross-sectional view of the scroll expander 8 incorporated with the auxiliary compressor 2. The expander 8, configured to expand the refrigerant and recover power, includes a spiral wrap 67 of an expander fixed scroll 59 and a spiral wrap 65 on the lower surface of an orbiting scroll 57. The auxiliary compressor 2, configured to compress the refrigerant using power recovered by the expander 8, includes a spiral wrap 66 of a compressor fixed scroll 58 and a spiral wrap 64 on the upper surface of the orbiting scroll 57. In other words, the spiral wrap 65 of the expander 8 and the spiral wrap 64 of the auxiliary compressor 2 are incorporated in a common base plate, constituting the orbiting scroll 57, such that the spiral wraps are arranged back to back on two surfaces of the base plate. Accordingly, when the orbiting scroll 57 orbits, compression can be achieved on one side and expansion can be achieved on the other side.

A high-temperature medium-pressure refrigerant discharged from the main compressor 1 is sucked in through a suction pipe 53 of the auxiliary compressor 2 and is introduced into an outer side of the auxiliary compressor 2 defined by the spiral wrap 66 of the compressor fixed scroll 58 and the spiral wrap 64 of the orbiting scroll 57. Orbiting of the orbiting scroll 57 allows the refrigerant to gradually move to an inner side of the auxiliary compressor 2, so that the refrigerant is compressed into a high-temperature high-pressure refrigerant. The compressed refrigerant is discharged out through a discharge pipe 54 of the auxiliary compressor 2.

Whereas, a high-pressure refrigerant cooled by the outdoor heat exchanger 4 or the indoor heat exchanger 32 is sucked in through a suction pipe 55 of the expander 8 and is introduced into an inner side of the expander 8 defined by the spiral wrap 67 of the expander fixed scroll 59 and the spiral wrap 65 of the orbiting scroll 57. Orbiting of the orbiting scroll 57 allows the refrigerant to gradually move to an outer side of the expander 8, so that the refrigerant is expanded into a low-pressure refrigerant. The expanded refrigerant is discharged out through a discharge pipe 56 of the expander 8. Power generated by expansion of the refrigerant in the expander 8 is recovered through the drive shaft 52 and is transferred as power for compression to the auxiliary compressor 2.

The above-described mechanism constituting the auxiliary compressor 2 and the expander 8 is housed in the container 51.

As features of the present invention, the expander 8 includes a communicating pipe 71, which allows expansion chambers during expansion to communicate with the discharge pipe 56 of the expander 8, and a solenoid valve 72, serving as an opening and closing device, provided to the connecting pipe 71. The communicating pipe 71 is in communication with an expansion chamber 82*a* at a position 90 degrees away from a terminal 73 of the spiral wrap 67 in a direction toward the center thereof and an expansion chamber 81*a* at a position 270 degrees away from the terminal 73 in the direction toward the center.

<Operation of Expander>

Figure 4:
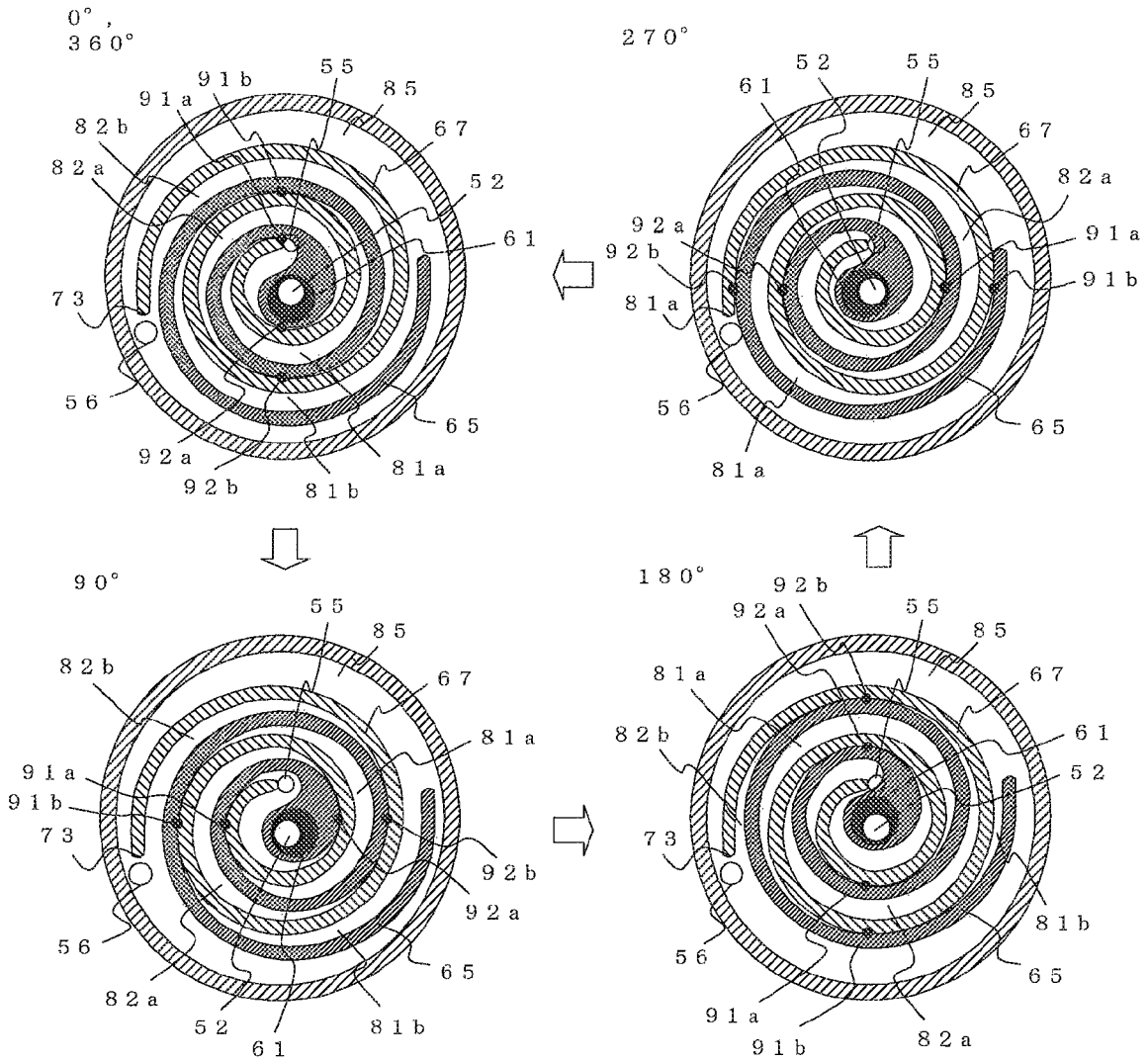
FIG. 4 includes schematic cross-sectional views of the spiral wraps, the views illustrating an operation of the positive displacement expander according to Embodiment 1 of the present invention.

An operation of the expander 8 will now be described with reference to FIG. 4. In the expander 8, the expansion chamber 81*a* is defined by a space between an outer surface of the spiral wrap 67 of the expander fixed scroll 59 and an inner surface of the spiral wrap 65 of the orbiting scroll 57. The expansion chamber 82*a* is defined by a space between an inner surface of the spiral wrap 67 of the expander fixed scroll 59 and an outer surface of the spiral wrap 65 of the orbiting scroll 57.

The crank angle of the drive shaft 52 is assumed to be 0 degree in a state in which an end portion of the center of the spiral wrap 67 is in contact with the inner surface of the spiral wrap 65. When the crank angle is 0 degree, the refrigerant is partitioned into the expansion chamber 81*a* and the expansion chamber 82*b*. The inflow of the high-pressure refrigerant into the expansion chamber 81*a* and the expansion chamber 82*a* continues until immediately before the crank angle reaches 360 degrees. Expansion of the refrigerant in a trapped state in the expansion chamber 81*a* and the expansion chamber 82*a* drives the orbiting scroll 57.

While the crank angle shifts from 270 degrees to 360 degrees (0 degree), expansion in the expansion chambers 81*a* and 82*a* terminates, so that the refrigerant is discharged to an expander discharge space 85. In a position at 360 degrees in FIG. 4, the expansion chambers 81*a* and 82*a* opening into the expander discharge space 85 are represented as expansion chambers 81*b* and 82*b*, respectively. The discharged refrigerant is expelled to the low-pressure side through the discharge pipe 56.

<Operation of Stopping Orbiting Scroll>

An operation of the expander 8 upon stopping the refrigeration cycle apparatus according to Embodiment 1, that is, the air-conditioning apparatus will now be described with reference to FIGS. 1 to 4. Stopping the air-conditioning apparatus means stopping the operation of the main compressor 1.

The orbiting scroll 57 continues orbiting while gradually reducing its rotation speed until high and low pressures are equalized after stop of the main compressor 1. When driving force of the expander 8 becomes smaller than the force of friction between the orbiting scroll 57 and the compressor fixed scroll 58 or the expander fixed scroll 59, the orbiting scroll 57 completely stops.

In Embodiment 1, the solenoid valve 72 is opened after stop of the main compressor 1 by the time when high and low pressures are equalized. During the orbiting of the orbiting scroll 57 until high and low pressures are equalized, the expansion chamber 81*a* becomes in communication with the discharge pipe 56 immediately after a contact point 91*b* between the outer surface of the spiral wrap 67 and the inner surface of the spiral wrap 65 passes the communicating pipe 71. In other words, the expansion chamber 81*a* is under low pressure. Similarly, the expansion chamber 82*a* becomes in communication with the discharge pipe 56 immediately after a contact point 92*b* between the outer surface of the spiral wrap 65 and the inner surface of the spiral wrap 67 passes the communicating pipe 71. In other words, the expansion chamber 82*a* is under low pressure.

When the expansion chambers 81*a* and 82*a* are under low pressure as described above, no difference in pressure between the expansion chambers 81*a* and 82*a* and the expander discharge space 85 will exist. Thus, the orbiting scroll 57 loses its driving force, such that the orbiting scroll can easily stop. In other words, the orbiting scroll 57 stops immediately after the contact points 91*b* and 92*b* pass the communicating pipe 71. Specifically, the communicating pipe 71 is connected to the expansion chambers 81*a* and 82*a* on the track of the contact points 91*b* and 92*b* during orbiting (revolving) of the orbiting scroll 57.

After the main compressor 1 and the expander 8 completely stop, the solenoid valve 71 is closed. Complete stop of the expander 8 means that the orbiting scroll 57 stops orbiting (revolving). Stop of the expander 8 can be determined after one or two minutes from the time when pressures detected by the pressure sensor 11 and that by the pressure sensor 12 are approximately equal.

<Effects of Improved Startup Performance Based on Stop Position of Orbiting Scroll>

Effects of improved startup performance by control of the stop position of the orbiting scroll 57 as in Embodiment 1 will be described.

Figure 5:
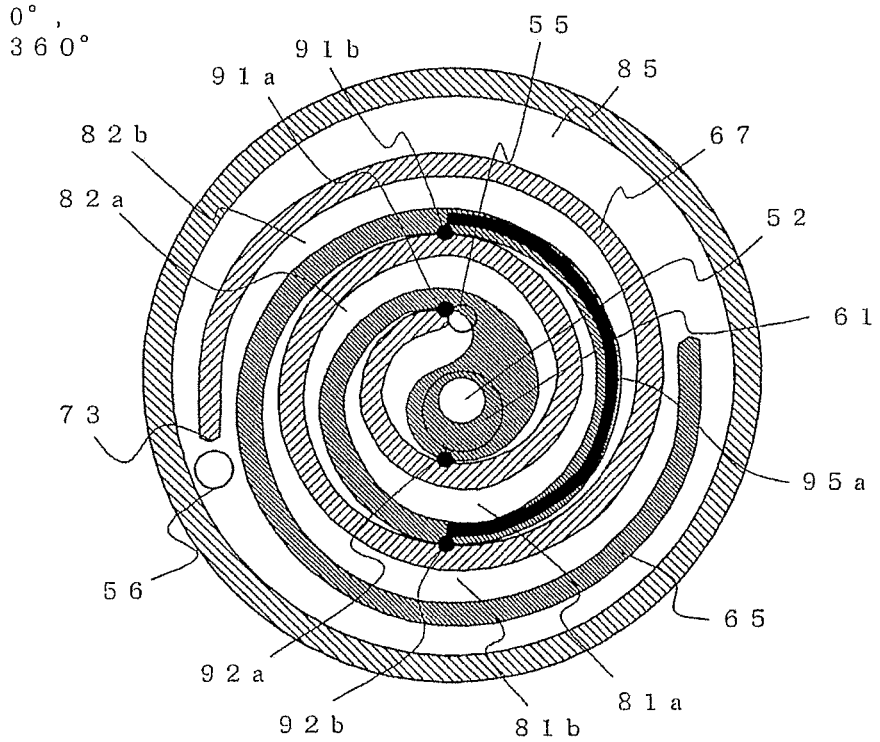
FIG. 5 is a schematic cross-sectional view of an exemplary stop position of the spiral wraps of the positive displacement expander in a comparative example.

FIG. 5 is a diagram illustrating the orbiting scroll 57 stopped after the expansion chambers 81*b* and 82*b* open into the expander discharge space 85 as in the related art and illustrates a stop position of the orbiting scroll 57 when the crank angle is 0 degree (360 degrees). In actuality, the orbiting scroll 57 stops while the crank angle lies in the range of 270 degrees to 360 degrees.

Figure 6:
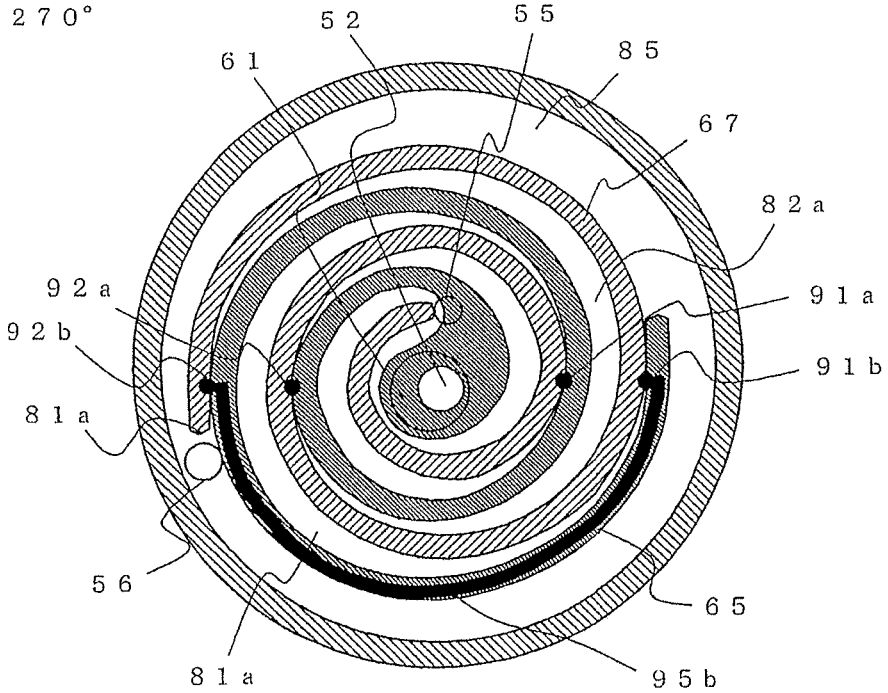
FIG. 6 is a schematic cross-sectional view of an exemplary stop position of the spiral wraps of the positive displacement expander according to Embodiment 1 of the present invention.

FIG. 6 is a diagram illustrating control of a stop position of the orbiting scroll 57 in Embodiment 1 and illustrates the position of the orbiting scroll 57 when the crank angle is 270 degrees. In actuality, the orbiting scroll 57 stops while the crank angle lies in the range of 180 degrees to 270 degrees.

Since high and low pressures in the air-conditioning apparatus are equalized after complete stop of the main compressor 1 and the expander 8, pressures in the circuit are substantially equalized. In the expander 8, pressures in the expansion chambers 81*a* and 82*a* and the expander discharge space 85 are equalized. In such a stopped mode, when the main compressor 1 is resumed, the refrigerant is gradually expelled through the discharge pipe 56, thus reducing the pressure in the expander discharge space 85.

Since the expansion chamber 81*a* is partitioned by the spiral wraps 65 and 67 and has not been opened to the expander discharge space 85, the pressure during the equalization is kept. Thus, a pressure difference exists between the expansion chamber 81*a* and the expander discharge space 85. Pressure receiving portion 95*a* or pressure receiving portion 95*b* that receives the pressure difference is a portion between the contact point 92*b* and the contact point 91*b* in the spiral wrap 65.

When driving force caused by the pressure difference received by the pressure receiving portion 95*a* or pressure receiving portion 95*b* is greater than static friction force applied to various sliding portions, such as the orbiting scroll 57 and an orbiting bearing 63, the orbiting scroll 57, which has stopped, starts orbiting.

Comparison between the pressure receiving portion 95*b* in the case where the orbiting scroll 57 is stopped while the stop position thereof is being controlled as in Embodiment 1 (FIG. 6) and the pressure receiving portion 95*a* in the case where the orbiting scroll 57 is stopped as in the related art in FIG. 5 will be made. In FIG. 5, the orbiting scroll 57 is stopped after opening the expansion chamber 81*b* and the expansion chamber 82*b* to the expander discharge space 85. Whereas, in FIG. 6, the orbiting scroll 57 is stopped before opening the expansion chamber 81*a* and the expansion chamber 82*b* to the expander discharge space 85, thus allowing the area of pressure reception of the pressure receiving portion 95*b* in FIG. 6 to be larger than that of the pressure receiving portion 95*a* in FIG. 5.

As described above, since the pressure receiving portion 95*b* that receives the difference between the pressure during the equalization and a low pressure upon startup of the air-conditioning apparatus can be further increased in Embodiment 1, force acting in the orbiting direction in which the orbiting scroll 57 is driven from the stopped mode can be further increased.

Furthermore, in Embodiment 1, since the connecting portions with the communicating pipe 71 is provided 90 crank angle degrees before the crank angle in which the expansion chamber 81*a* and the expansion chamber 82*a* each open into the expander discharge space 85, the pressure receiving portion 95*b* when the air-conditioning apparatus is resumed can be increased. The angular positions in which the portions connected to the communicating pipe 71 are not limited to the above-described positions. As long as the pressure receiving portion 95*b* can be increased, the portions may be arranged in any position. However, it is effective to provide each portion between the position where the expansion chambers 81*a* and 82*a* each opens into the expander discharge space 85 and a position 90 degrees before each corresponding opening position.

Furthermore, while two portions connected to the communicating pipe 71 are arranged in Embodiment 1, a single portion may be disposed in order to increase workability.

Furthermore, in Embodiment 1, since driving force applied to the orbiting scroll 57 is smaller than static friction force applied to various sliding portions, such as the orbiting scroll 57 and the orbiting bearing 63, startup failure that the orbiting scroll 57 does not orbit can be reduced. Thus, the reliability of the air-conditioning apparatus can be further increased.

Furthermore, while Embodiment 1 has been described with respect to the case where the present invention is applied to a scroll expander, the application is not limited to a scroll type, but the present invention is applicable to, for example, a rotary expander including a rolling piston.

Specifically, even in the rotary expander, the area of pressure reception varies depending on a stop position of the rolling piston. Disadvantageously, insufficient revolution of the rolling piston may occur upon startup of the air-conditioning apparatus. Therefore, the communicating pipe 71 allows chambers partitioned by the rolling piston to communicate with a discharge pipe (low-pressure side), so that the stop position of the rolling piston can be controlled. Consequently, the area of pressure reception can be increased so that startup failure does not easily occur.

Furthermore, in Embodiment 1, when starting up the expander 8, means for forcing the orbiting scroll 57 to orbit, for example, using a power recovery generator as a motor is not required. The orbiting scroll 57 can be allowed to orbit only using fluid energy generated during decompression of the refrigerant by the expander. Thus, the structure of the expander 8 can be simplified.

Furthermore, in Embodiment, the solenoid valve 72 is used as an opening and closing device for the communicating pipe 71. Needless to say, other opening and closing devices may be used.

Embodiment 2

Figure 7:
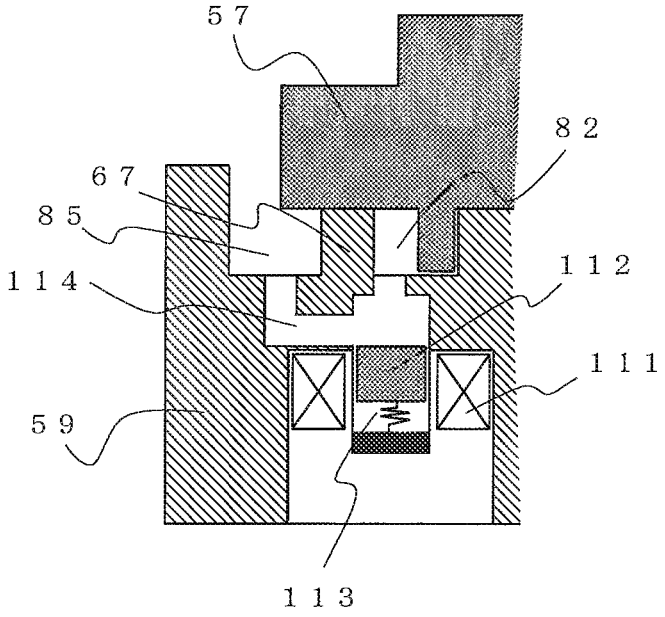
FIG. 7 is a schematic cross-sectional view of an opened state of an opening and closing device, which is a main section of a positive displacement expander according to Embodiment 2 of the present invention.
Figure 8:
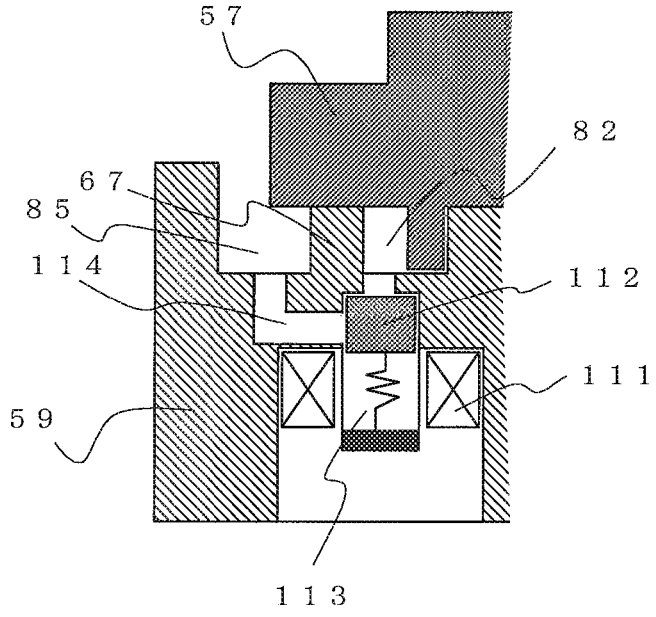
FIG. 8 is a schematic cross-sectional view of a closed state of the opening and closing device, which is the main part of the positive displacement expander according to Embodiment 2 of the present invention.

In the above-described Embodiment 1, the communicating pipe 71 and the solenoid valve 72 are arranged outside the container 51. Embodiment 2 in which the communicating pipe 71 and the valve are housed in the container 51 will now be described. FIG. 7 is a diagram illustrating an opened state of the valve in this case. FIG. 8 is a diagram illustrating a closed state of the valve.

In FIG. 7, electromagnetic force produced by excitation of a coil 111 allows a valve 112 to be in a lower position (valve opened state). At this time, a communicating path 114 allows an expansion chamber 82 to be in communication with the expander discharge space 85, so that the refrigerant in the expansion chamber 82 is expelled to the expander discharge space 85. During the stopping of the air-conditioning apparatus described in the foregoing Embodiment 1, this state is obtained.

Referring to FIG. 8, the excitation of the coil 111 is turned off such that the valve 112 is pushed upward by elastic force of a spring 113. Accordingly, the expansion chamber 82 is not in communication with the expander discharge space 85. During operation of the air-conditioning apparatus, or after complete stop of the expander 8, this state is obtained.

In Embodiment 2, the coil 111, the valve 112, and the spring 113 provide the same function as that of the above-described solenoid valve 72. Since these components are housed in the container 51, the air-conditioning apparatus can be reduced in size.

In the above description, for convenience of explanation, each of the coil 111, the valve 112, the spring 113, and the communicating path 114 is illustrated as a single component. However, another coil 111, another valve 112, another spring 113, and another communicating path 114 are arranged for communication between an expansion chamber 81 and the expander discharge space 85. Alternatively, each of these components may be a single component.

REFERENCE SIGNS LIST

1 main compressor; 2 auxiliary compressor; 3 first four-way valve; 4 outdoor heat exchanger; 5 bypass valve; 6 second four-way valve; 7 pre-expansion valve; 8. expander; 9 accumulator; 11, 12 pressure sensor; 21 discharge pipe of main compressor 1; 22 inlet or outlet pipe of outdoor heat exchanger; 23 suction pipe of expander 8; 24 discharge pipe of expander 8; 25 bypass; 26 pipe; 27 liquid pipe; 28 gas pipe; 29 inlet pipe of accumulator 9; 31 expansion valve; 32 indoor heat exchanger; 51 container; 52 drive shaft; 53 suction pipe of auxiliary compressor 2; 54 discharge pipe of auxiliary compressor 2; 55 suction pipe of expander 8; 56 discharge pipe of expander 8; orbiting scroll; 58 compressor fixed scroll; 59 expander fixed scroll; 60 Oldham's ring; 61 slider; 62 shaft fitting hole; 63 orbiting bearing; 64 spiral wrap on upper surface of orbiting scroll 57; 65 spiral wrap on lower surface of orbiting scroll 57; 66 spiral wrap of compressor fixed scroll 58; 67 spiral wrap of expander fixed scroll 59; 68 oil pump; 69 lubricating oil; 70 balancer; 71 communicating pipe; 72 solenoid valve; 73 terminal of spiral wrap 67; 81*a*, 81*b* expansion chamber; 82*a*, 82*b* expansion chamber; 85 expander discharge space; 91*a*, 91*b* contact point between outer surface of spiral wrap 67 and inner surface of spiral wrap 65; 92*a*, 92*b* contact point between outer surface of spiral wrap 65 and inner surface of spiral wrap 67; 95*a*, 95*b* pressure receiving portion; 111 coil; 112 valve; 113 spring; 114 communicating path.

The invention claimed is:

1. A positive displacement expander that generates power using fluid energy generated while a high-pressure fluid, supplied to a plurality of expansion chambers partitioned by an orbiting scroll, is being expanded and decompressed, the positive displacement expander comprising:

an expander discharge space to which the fluid expanded at the expansion chambers discharges;

a discharge pipe that discharges the fluid from the expander discharge space;

a communicating pipe that allows each of the expansion chambers to communicate with the discharge pipe;

a solenoid valve disposed in the communicating pipe, and a controller operatively connected to said solenoid valve and controlling said solenoid valve, said controller configured to open the solenoid valve, in a time period after the supply of the high-pressure fluid to the expansion chambers has stopped and prior to a time when the pressures of each of the expansion chambers and the discharge pipe would be equalized, and the controller opening said solenoid valve within said time period so as to equalize the pressure between each of the expansion chambers and the discharge pipe in such a way that the orbiting scroll is stopped at a predetermined position.

2. The positive displacement expander of claim 1, wherein the orbiting scroll is supported by an orbiting bearing, and the predetermined stop position of the orbiting scroll is a position where, when the supply of the high-pressure fluid to the expansion chambers is started, driving force applied to the orbiting scroll is greater than static friction force applied to a sliding surface between the orbiting scroll and the orbiting bearing.

3. The positive displacement expander of claim 1, wherein each of the plurality of expansion chambers is defined by a space between a spiral wrap of the orbiting scroll and a spiral wrap of an expander fixed scroll opposite to the spiral wrap of the orbiting scroll, and the predetermined stop position of the orbiting scroll is a position where the space of the expansion chamber formed at a terminal of the spiral wrap of the orbiting scroll, and the space of the expansion chamber formed at a terminal of the spiral wrap of the expander fixed scroll is maximum.

4. The positive displacement expander of claim 1, wherein each of the plurality of expansion chambers is defined by a space between a spiral wrap of the orbiting scroll and a spiral wrap of an expander fixed scroll opposite to the spiral wrap of the orbiting scroll, and the communicating pipe is in connection at a position between a first location where an expansion chamber defined at a terminal of the spiral wrap of the orbiting scroll and an expansion chamber defined at a terminal of the spiral wrap of the expander fixed scroll open to the expander discharge space and a second location 90 degrees away from the first location in the direction opposite to the direction in which the orbiting scroll revolves.

5. The positive displacement expander of claim 1, wherein the fluid is carbon dioxide.

6. A refrigeration cycle device comprising:

an expander that is the positive displacement expander of claim 1.

7. A positive displacement expander that generates power using fluid energy generated while a high-pressure fluid, supplied to a plurality of expansion chambers partitioned by a rolling piston, is being expanded and decompressed, the positive displacement expander comprising:

an expander discharge space to which the fluid expanded at the expansion chambers discharges;

a discharge pipe that discharges the fluid from the expander discharge space;

a communicating pipe that allows each of the expansion chambers to communicate with the discharge pipe;

a solenoid valve disposed in the communicating pipe; and a controller operatively connected to said solenoid valve and controlling said solenoid valve, said controller configured to open the solenoid valve, in a time period after the supply of the high-pressure fluid to the expansion chambers has stopped and prior to a time when the pressures of each of the expansion chambers and the discharge pipe would be equalized, and the controller opening said solenoid valve within said time period so as to equalize the pressure between each of the expansion chambers and the discharge pipe in such a way that the rolling piston is stopped at a predetermined position.

8. The positive displacement expander of claim 7, wherein the rolling piston is supported by an orbiting bearing, and the predetermined stop position of the rolling piston is a position where, when the supply of the high-pressure fluid to the expansion chambers is started, driving force applied to the rolling piston is greater than static friction force applied to a sliding surface between the rolling piston and the orbiting bearing.

* * * * *